US005249807A

United States Patent [19]

Peterson

[11] Patent Number: 5,249,807

[45] Date of Patent: Oct. 5, 1993

[54] PERCEPTION GAME APPARATUS

[76] Inventor: Mark S. Peterson, 1700 N. Tully Rd., #A-116, Turlock, Calif. 95380

[21] Appl. No.: 981,107

[22] Filed: Nov. 24, 1992

[51] Int. Cl.[5] ..... A63F 3/00; A63F 5/04

[52] U.S. Cl. ..... 273/242; 273/141 R; 273/142 R; 273/148 R; 273/431

[58] Field of Search ..... 273/243, 249, 141 R, 273/141 A, 256, 242, 142 R

[56] References Cited

U.S. PATENT DOCUMENTS 3,226,122 12/1965 Rogers ..... 273/272
3,939,578 2/1976 Coffey ..... 273/243
4,243,223 6/1981 Ver Hoef et al. ..... 273/141 R
4,743,029 5/1988 Consolatore et al. ..... 273/243
4,854,594 8/1989 Eaton ..... 273/249
4,902,020 2/1990 Auxler ..... 273/256

*Primary Examiner*—Benjamin H. Layno
*Attorney, Agent, or Firm*—Leon Gilden

[57] ABSTRACT

An apparatus to exercise, sharpen, and test extrasensory perception capacity of individuals is provided to include various categories of testing events about a game path, with points awarded relative to correct responses to award various levels of extrasensory perception capacity to a player or a plurality of players of the game structure.

1 Claim, 4 Drawing Sheets

PERCEPTION GAME APPARATUS

BACKGROUND OF THE INVENTION

1. Field of the Invention

The field of invention relates to game apparatus, and more particularly pertains to a new and improved perception game apparatus wherein the same is directed to the apparatus to test the perceptive capacity of individuals.

2. Description of the Prior Art

Apparatus utilizing board game structure has been employed in the prior art for competitive play among individuals and indicated by U.S. Pat. Nos. 4,915,391; 4,966,371; 4,900,032; 4,936,589; and 4,984,806.

The instant invention sets forth game apparatus played by individuals or groups thereof for testing perceptive and extrasensory perception capacity of the individuals and in this respect, the present invention substantially fulfills this need.

SUMMARY OF THE INVENTION

In view of the foregoing disadvantages inherent in the known types of game apparatus now present in the prior art, the present invention provides a perception game apparatus wherein the same is directed to the testing of extrasensory perception capacity of individuals. As such, the general purpose of the present invention, which will be described subsequently in greater detail, is to provide a new and improved perception game apparatus which has all the advantages of the prior art game apparatus and none of the disadvantages.

To attain this, the present invention provides an apparatus to exercise, sharpen, and test extrasensory perception capacity of individuals, to include various categories of testing events about a game path, with points awarded relative to correct responses to award various levels of extrasensory perception capacity to a player of a plurality of players of the game structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved perception game apparatus which has all the advantages of the prior art game apparatus and none of the disadvantages.

It is another object of the present invention to provide a new and improved perception game apparatus which may be easily and efficiently manufactured and marketed.

It is a further object of the present invention to provide a new and improved perception game apparatus which is of a durable and reliable construction.

An even further object of the present invention is to provide a new and improved perception game apparatus which is susceptible of a low cost of manufacture with regard to both materials and labor, and which accordingly is then susceptible of low prices of sale to the consuming public, thereby making such perception game apparatus economically available to the buying public.

Still yet another object of the present invention is to provide a new and improved perception game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
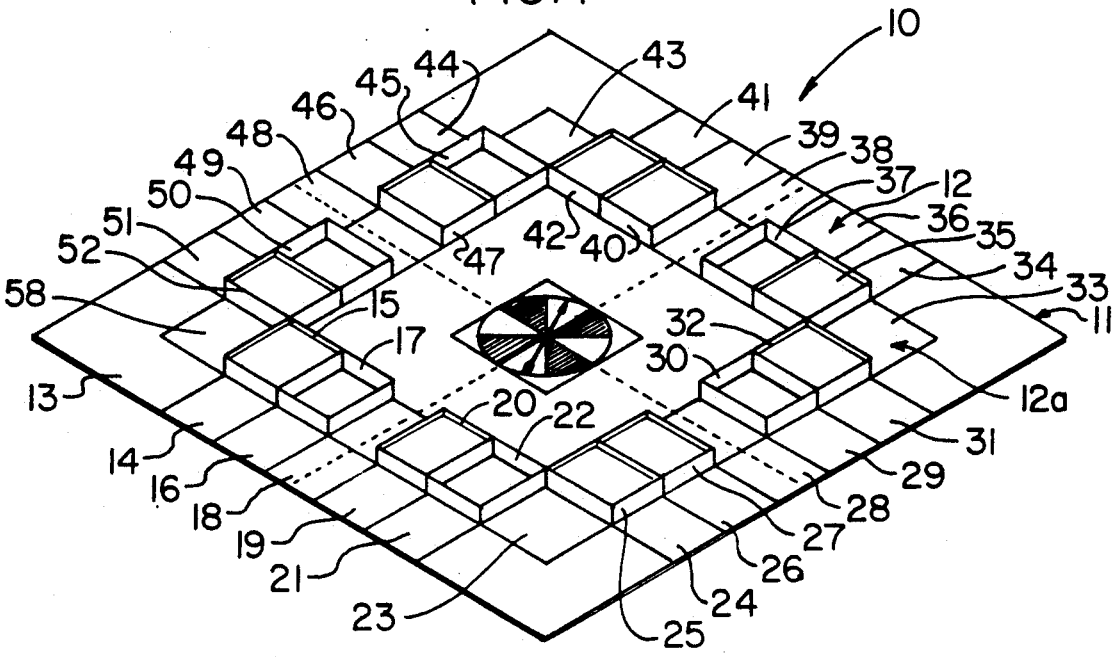
FIG. 1 is an isometric illustration of the invention.
Figure 2:
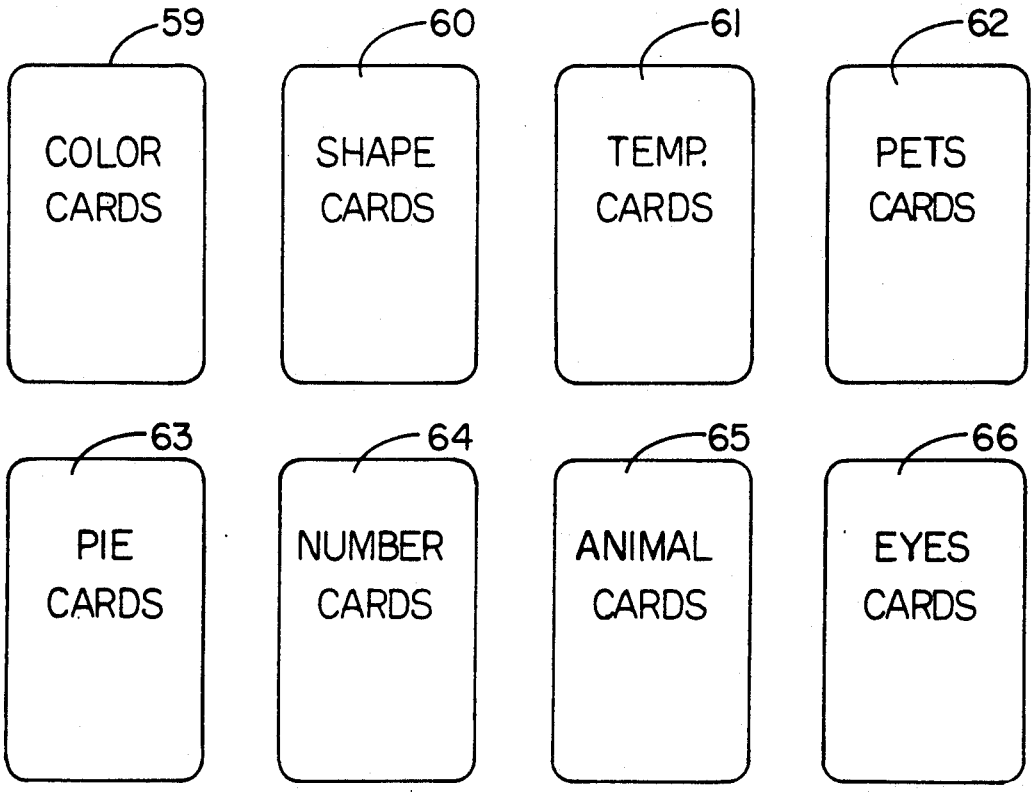
FIG. 2 is an orthographic top view of card categories employed by the invention.
Figure 3:
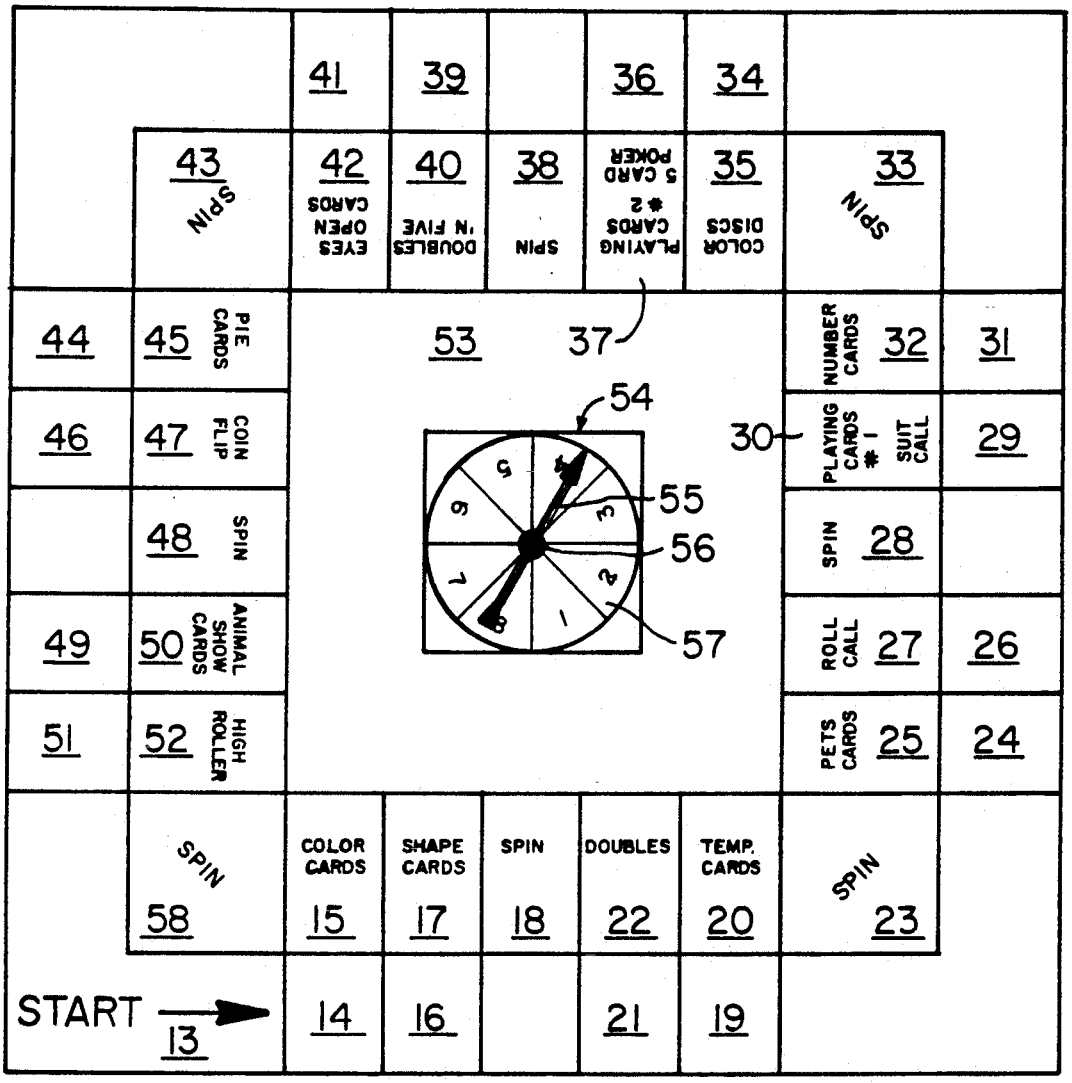
FIG. 3 is an orthographic detailed view of the game board of the invention.
Figure 4:
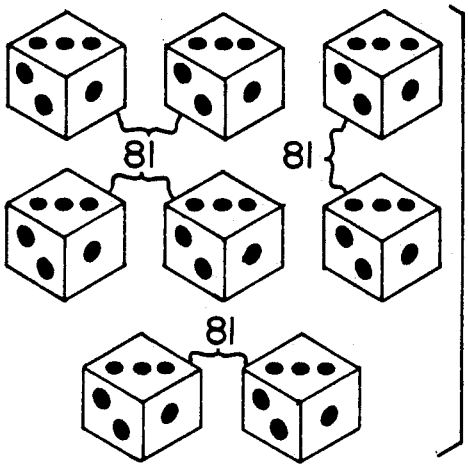
FIG. 4 is an isometric illustration of the dice member utilized by the invention.
Figure 5:
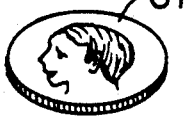
FIG. 5 is an isometric illustration of a coin member utilized by the invention.
Figure 6:
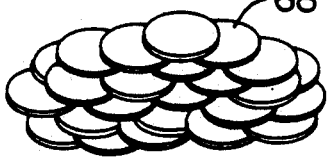
FIG. 6 is an isometric illustration of first tokens employed by the invention.
Figure 7:
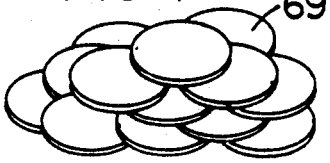
FIG. 7 is an isometric illustration of second tokens employed by the invention.
Figure 8:
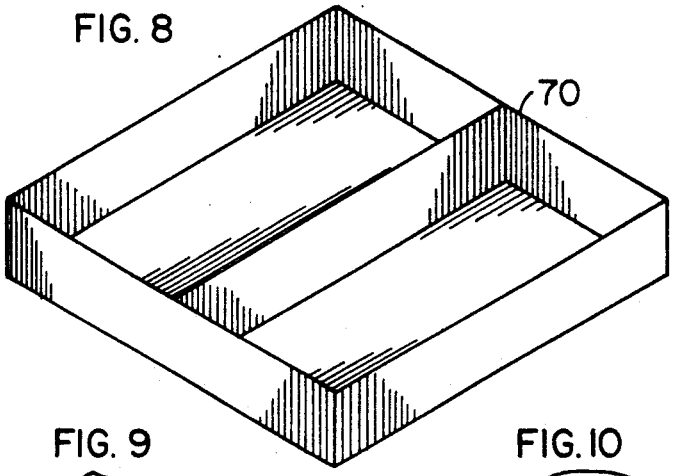
FIG. 8 is an isometric illustration of container structure for the invention for housing and transporting the same.
Figure 9:
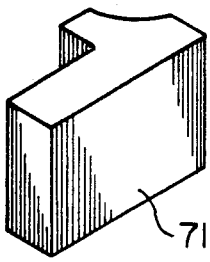
FIGS. 9, 10, 11, 12, 13, 14, 15, 16, 17, and 18 are examples of game tokens for use by the individuals in the invention.
Figure 10:
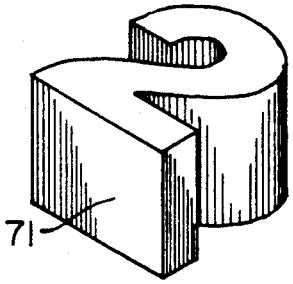
Figure 11:
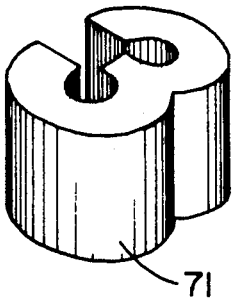
Figure 12:
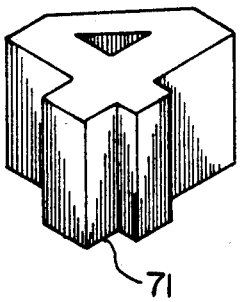
Figure 13:
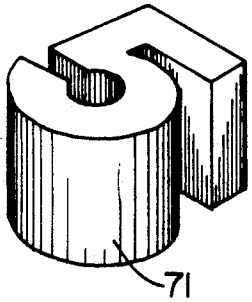
Figure 14:
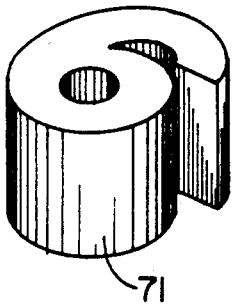
Figure 15:
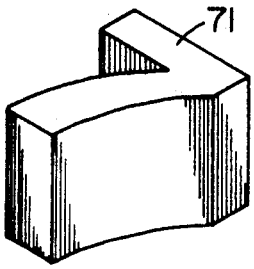
Figure 16:
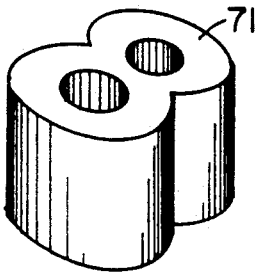
Figure 17:
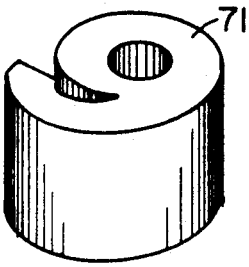
Figure 18:
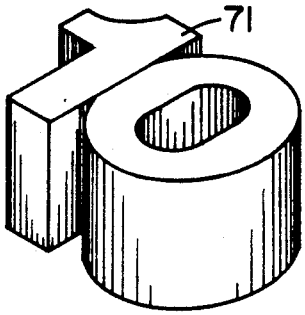

With reference now to the drawings, and in particular to FIGS. 1 to 20 thereof, a new and improved perception game apparatus embodying the principles and concepts of the present invention and generally designated by the reference numeral 10 will be described.

More specifically, the perception game apparatus 10 of the instant invention essentially comprises a game board 11, having a continuous outer path of spaces 12 arranged continuously and adjacent the outer periphery of the game board, with a continuous inner path of spaces 12*a* arranged in adjacency to the outer path of spaces 12, with a single inner space of the inner path 12*a* positioned in alignment with a single one of the spaces of the outer path of spaces 12. The inner path 12*a* includes various directional indications, with the outer path free of directions with the exception of the start space 13 where all player tokens of the player tokens 71, as indicated in the FIGS. 9–18, begin. It should be noted that the tokens 71 are by means of example and are not limited thereto, but wherein contrastingly configured tokens for the various players, as well as contrastingly colored type tokens, may be employed.

The inner path of spaces 12*a* begins with start spin space 58 positioned within the start space defined as a first spin space. In employment of a spin space, the spinner assembly 54 is employed, wherein the spinner assembly includes a plurality of segmented components 57 of a generally pie shaped configuration, with a pointer leg 55 rotatably mounted about an axle 56. The segments 57 employ an even number of integers, wherein an individual may select whether an even or odd integer is to be concluded by spinning of the pointer leg 57, or whether a color of a plurality of colors, typically two colors are utilized for the various segments 57, or a player may choose an exact integer to be concluded by spinning of the spinner assembly 54. An attempt at spinning the spinner assembly 54 by each player successfully are effected, with a correct selection of a predetermined integer being awarded one hundred fifty points, with a correct response being awarded as twenty-five points as to whether one of a plurality of colors is selected or whether an even or odd integer is to be effected by the spinning of the pointer leg 55.

At the player's next turn that is sequenced after the remaining players have had their appropriate turn at the spinner assembly, a first space 14 of the outer space is positioned adjacent a first container 15 having a deck of first cards 59 directed to the coloration of cards. Five different colors are indicated by the cards, wherein at this juncture, the cards are shuffled and a player must pre-announce a color to be selected from the deck, with three attempts. Each correct selection being awarded twenty-five points. The second space 16 of the outer path is positioned in adjacency relative to a second container 17, having a deck of second cards 60 of shape cards. The shape cards are shuffled, wherein twenty-five cards utilizing a plurality of shapes such as five shapes, to include a circle, a square, a rectangle, an oval, and triangle for example are provided, with three attempts made with each correct shape being pre-announced being awarded twenty-five points. The third space 18 is indicated as a second spin space to direct each player to further utilize the spinner assembly 54, in a manner as indicated above relative to the selection of an even or odd integer, a coloration of a plurality of colors or a predetermined integer of the segments 57. The fourth space 19 of the outer path 12 includes a fourth container 20 in adjacency thereto of the inner path 12*a*. The fourth container 20 includes a deck of temperature cards 61 having four different temperature selections such as hot, cold, warm, and cool. Three attempts are made subsequent to shuffling, with each correct preselection of a temperature being awarded twenty-five points. The fifth space 21 and fifth container 22 includes an orientation for the utilizing the dice members 81. An even such number of dice members greater than four, and typically eight, are employed, wherein a player in turn throws the plurality of dice members 81 and priorly indicates the number of doubles to appear. The doubles to indicate the duplication of integers showing face up by two of the dice members 81. A correct response is worth twenty-five points. The sixth space 23 indicates a third spin space for use of the spinner assembly 54, in a manner as priorly described. The seventh space 24 is in association with a seventh container 25, wherein a deck of pet cards indicating various pets to include cards 62, wherein the cards are shuffled with twenty-five cards having five different types of pets such as a dog, a cat, a bird, a fish, and a horse, wherein priorly correctly describing the card to be selected is worth twenty-five points. The eighth space 26 is in association with an eighth container 27 of the inner path 12*a* and is for a roll-call, wherein two of the dice 81 are employed and are rolled five times, with the player priorly describing the total accumulated by the five rolls. A correct answer being worth two hundred points. The ninth space 28 is a fourth spin space for use of the spinner assembly 54 in a like manner as noted above.

The tenth space 29 of the outer path is in adjacency relative to a tenth container 30 of the inner path, with the tenth container 30 having a deck of playing cards provided, with the playing cards shuffled and a player to announce the suit of cards to be selected. There are fifty-two cards, with four different suits such as diamonds, hearts, clubs, and spades, with three attempts and with each correct suit being selected being worth twenty-five points. The tenth space 29 of the outer path cooperative with a tenth container 30 of the inner path utilizes a deck of the number cards 64, with the number cards being provided of thirty-six cards numbered one through nine. Three attempts are made, with each correct answer being worth seventy-five points and preselection of an integer of the integers of one through nine. The twelve space 33 of the inner path is a fifth spin space.

The thirteenth space 34 of the outer path is in adjacency to a thirteenth container 35 of the inner path utilized in cooperation with a plurality of the multi-colored discs 69. Four discs are chosen individually. There are twenty discs with four colorations such as red, blue, yellow, and green, with fifty points awarded upon an individual pre-selecting and indicating the colors selected in the four discs to be subsequently picked from the discs 69. The fourteenth space 36 is cooperative with a fourteenth container 37 of the inner path, with the fourteenth container having a poker type game selection, wherein of the fifty-two card deck, the cards are shuffled, five cards are dealt alternatively to an imaginary dealer and a player face down. Without priorly seeing what cards have been dealt, a player must determined whether or not the dealer is beaten. A correct response and prediction being worth one hundred points. The fifteenth space 38 is a sixth spin space for use of the spinner assembly 54. The sixteenth space 39 of the outer path is cooperative with a sixteenth container 40 of the inner path, wherein the dice members 81 are utilized and a player must quickly determine whether doubles will be rolled in five rolls. Three attempts are made with a correct determination being worth fifty points. Optionally, only two of the dice members 81 are employed in the five rolls. The seventeenth space 41 of the outer path is cooperative with a seventeenth container 42 of the inner path. The seventeenth container 42 having the deck of cards 66. The eye cards 66 such that an eye, indicated as either open or closed, of twenty cards. Ten cards indicate the eyes open, with ten cards indicating the eyes closed. The player predicts or attempts to predict whether the eye card to be selected is open or closed, with the correct response being worth twenty-five points. The eighteenth space 43 of the inner path of an outer corner path space is a spin space utilizing the spinner assembly 54. The nineteenth space 44 of the outer path is positioned in adjacency relative to a nineteenth container 45, with the nineteenth container 45 utilizing pie cards. The pie cards are such that cards 63 have sixteen cards, with the pie indicated as a one-fourth, one-half, three-fourths, or a whole pie, wherein a player must attempt to predict the configuration of pie subsequently selected, with a correct response being awarded twenty-five points, with three attempts being provided the player. The twentieth space 46 cooperative with a twentieth container 47 of the inner path, with the twentieth container arranged to accommodate a coin 67 having a head and a tail side, and a player to attempt to pre-select whether a head or a tail is to be showing subsequent to a flipping of the coin. Five attempts are provided with fifty points awarded each correct response. The twenty-first space 48 of the inner path is a spin space. The twenty-second space 49 of the outer path is positioned adjacent relative to a twenty-second container 50 of the inner path, having a deck of the animal cards 65, with the animal cards being such that twenty cards having mammals, birds, fish, and reptiles being provided, with three attempts afforded each player, with a correct prediction of the card to be selected being awarded twenty-five points. The twenty-third space of the outer path is positioned in adjacency relative to a twenty-third container 52 of the inner path, with the use of a high roller situation, wherein a number is declared such as 2–12 that a player believes can be rolled within five rolls utilizing two of the dice members 81. Two hundred points is awarded if a correct number is predicted. It should be noted that the spinner assembly 54 is positioned within the central board space 53 of the game board 11 for access to all the players.

The player having attained the greatest number of points is declared a winner. Should the players decide to proceed about the game board in more than one lap and utilize a plurality of laps around the game board, a plurality of black tokens 68 are provided for each player to indicate a completion of a lap around the game board. The marker tokens may be positioned adjacent each player for such indication by other players.

Figure 19:
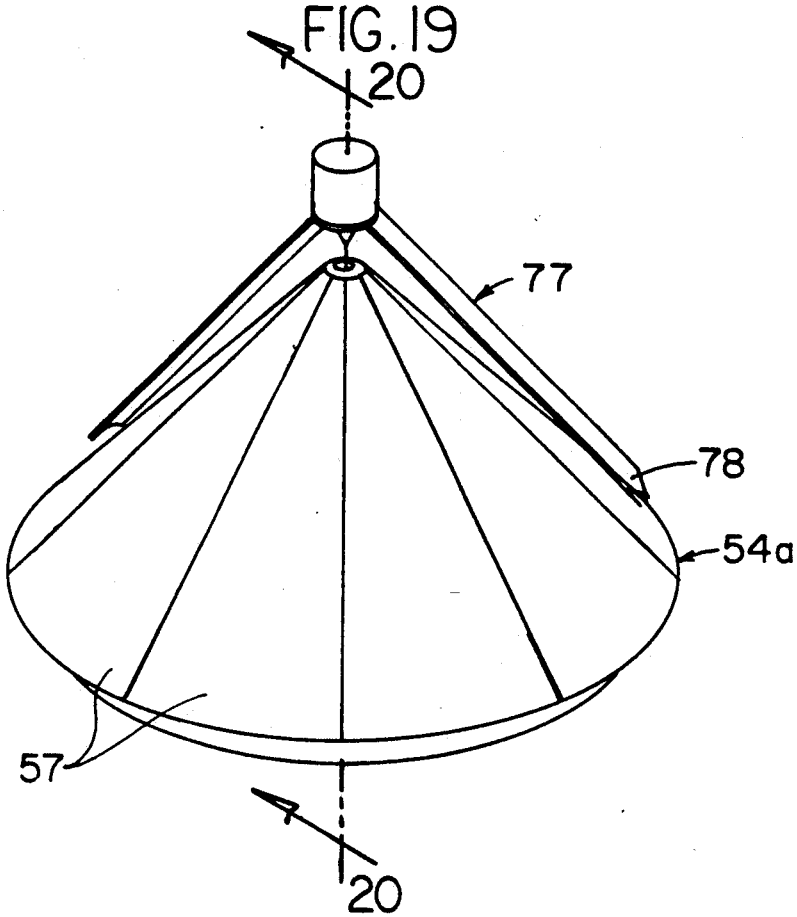
FIG. 19 is an isometric illustration of a modified spinner assembly of the invention.
Figure 20:
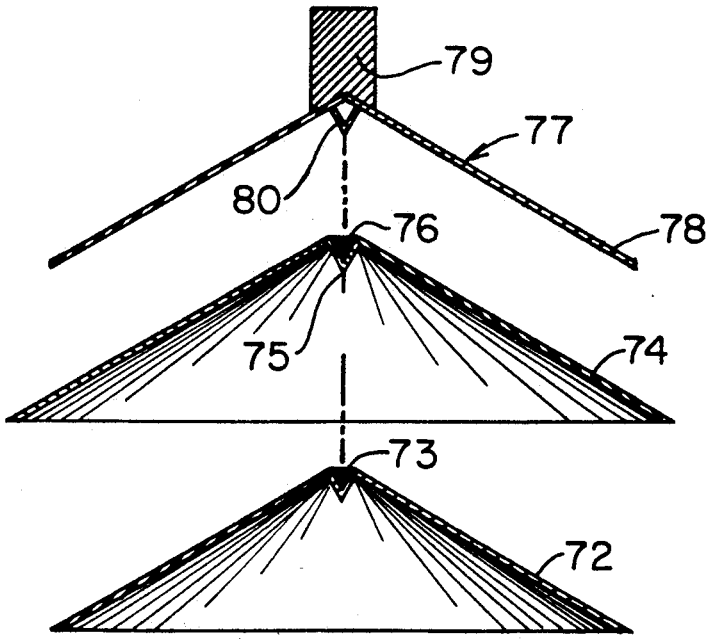
FIG. 20 is an orthographic view, taken along the lines 20—20 of FIG. 19 in the direction indicated by the arrows.

The FIGS. 19 and 20 indicate the use of a modified spinner assembly **54*a* having a conical base support 72, including a conical base support recess 73 at an apex of the base support, with the recess 73 arranged for receiving a conical spinner board projection 75 of a conical spinner board 74 positioned over and rotatably mounted onto the base support 72. The conical spinner board 74 includes the pie shaped segments indicated about the conical spinner board 74. A generally V-shaped pointed marker 77 having indicator leg as one of the legs of the pointer member includes a cylindrical handle 79 mounted fixedly at the apex for ease of rotation of the indicator leg and the pointer member 77. The pointer member 77 includes a pointer member conical projection 80 projecting from the apex thereof received within the conical spinner board conical recess 76. In this manner, simultaneous rotation of the pointer member 77, as well as the spinner bore 74 is provided for further adding elements of chance as to the integer and color to be indicated by the indicator leg 78 of the pointer member 77 relative to the segments 57**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A perception game apparatus, comprising, a game board, the game board having an outer periphery, with an outer path of outer path spaces directed continuously about the game board adjacent the outer periphery, and an inner path of spaces positioned coextensively with the outer path of spaces adjacent to the outer path of spaces, and the outer spaces having a start space, wherein each of the outer path of spaces to exclude the start space are blank, with each of the outer path of spaces positioned in adjacency relative to one of the inner path of spaces, and the inner path of spaces to include a plurality of spin spaces in cooperation with a spinner assembly, and the game board having a central board space, with the spinner assembly mounted on the central board space, the spinner assembly including a conical shaped support having a first apex forming the top of said support and a larger circular shaped base forming the bottom of said support with the first apex having a first apex recess of a conical configuration, a conical shaped spinner board having a second apex with the second apex having a second apex recess of a conical configuration, said conical spinner board including an array of pie shaped segment indicia of various digital enumerations and of a plurality of colors mounted on the outer surface of said conical shaped spinner board, and a V-shaped pointer member including cylindrical handle mounted at the apex of the V-shaped pointer member, the V-shaped pointer member being shaped to correspond to said conical shaped spinner board and said pointer member including a projection mounted on its apex and shaped to be received within the second recess wherein the V-shaped pointer member lies parallel to the surface of the conical shaped spinner board, the conical shaped spinner board being shaped to correspond to the surface of said conical support and said conical shaped spinner board having a projection from said second apex recess received within the first recess wherein the surface of said conical shaped spinner board concentrically covers and lies parallel to the surface of said conical shaped support permitting free rotation simultaneously of the conical shaped spinner board relative to conical shaped base support and free rotation of the V-shaped pointer member relative to the conical shaped spinner board, wherein a player of a plurality of players pre-selects selectively a predetermined number, an even or odd number to be directed by the spinner assembly, and a predetermined coloration, the inner path includes a plurality of containers, with each of the containers including a single deck of cards of a plurality of decks of cards, wherein landing upon an outer space of said outer path of spaces in adjacency to one of said containers directs a player to predict a card selected from said container, and said decks of cards include a first deck of coloration cards, a deck of shape cards, a deck of temperature cards, a deck of pet cards, a deck of pie cards, a deck of number cards, a deck of animal cards, and a deck eye cards.

* * * * *